US008210337B2

(12) United States Patent
Zwieg et al.

(10) Patent No.: US 8,210,337 B2
(45) Date of Patent: Jul. 3, 2012

(54) METHOD AND SENSOR FOR SENSING COINS FOR VALUATION

(75) Inventors: Robert L. Zwieg, Watertown, WI (US); Daniel Brandle, Amrisil (SE); John P. Grajewski, Palmyra, WI (US); Jon R. Stieber, Oconomowoc, WI (US); Thomas P. Adams, Oconomowoc, WI (US)

(73) Assignee: Talaris Inc., Watertown, WI (US)

( * ) Notice: Subject to any disclaimer, the term of this patent is extended or adjusted under 35 U.S.C. 154(b) by 1355 days.

(21) Appl. No.: 11/893,842

(22) Filed: Aug. 17, 2007

(65) Prior Publication Data

US 2009/0048803 A1 Feb. 19, 2009

(51) Int. Cl.
*G07D 5/02* (2006.01)

(52) U.S. Cl. ..... 194/334

(58) Field of Classification Search ..... 194/334; 209/539; 359/663; 73/163
See application file for complete search history.

(56) References Cited

U.S. PATENT DOCUMENTS

| | | | | |
|---|---|---|---|---|
| 4,483,431 | A * | 11/1984 | Pratt | 194/317 |
| 6,729,461 | B2 | 5/2004 | Brandle et al. | |
| 2002/0074210 | A1 * | 6/2002 | Brandle et al. | 194/334 |
| 2006/0219876 | A1 | 10/2006 | Halter | |

FOREIGN PATENT DOCUMENTS

| | | | |
|---|---|---|---|
| EP | 1 077 434 | A1 | 2/2001 |
| WO | WO 01/91063 | A1 | 11/2001 |
| WO | WO 2006/064008 | A1 * | 6/2006 |

* cited by examiner

*Primary Examiner* — Mark Beauchaine
(74) *Attorney, Agent, or Firm* — Boyle Fredrickson, S.C.

(57) ABSTRACT

A coin sensor and method of identifying coins by size and also discriminating invalid coins includes a portion of a coin track (63) over which coins (14) pass in a single file, an illumination source (92) for illuminating at least portions of the coins (14) as the coins move along the coin track (63), an optical detector (95) spaced from the coin track (63) for detecting a size of at least a portion of each coin passing the coin sensor along the coin track, and a telecentric lens (94) positioned between the optical detector (95) and the coin track (63), such that the portion of each coin passing the optical detector (95) is seen to have an apparent size and configuration independent of a variation in distance of the coin from the telecentric lens (94) as each coin moves along the coin track (63). The optical sensor and detector (90) can be angled to assist in preventing stray light from the bottom of the coins from being transmitted to the detector (95). The sensor assembly (67) also includes inductive sensors (98, 99) and a Hall effect sensor (97) for discriminating invalid coins.

14 Claims, 18 Drawing Sheets

METHOD AND SENSOR FOR SENSING COINS FOR VALUATION

TECHNICAL FIELD

The invention relates to coin handling equipment and, more particularly, equipment for counting coinage and detecting invalid coins.

BACKGROUND ART

In Zwieg et al., U.S. Pat. No. 5,992,602, coins were discriminated by using an inductive sensor to take three readings as each coin passed through a coin detection station and these readings were compared against prior calibrated limits for the respective denominations. If a coin did not fall within certain specifications it was offsorted.

The optical sensing of coins in coin handling equipment has been known since Zimmermann, U.S. Pat. No. 4,088,144 and Meyer, U.S. Pat. No. 4,249,648. Zimmermann discloses a linear rail sorter with a row of photocells disposed across a coin track. Zimmermann does not disclose repeated measurements of a coin dimension as it passes the array, but suggests that there may have been a single detection of the largest dimension of the coin based on the number of photocells covered by a coin as it passes. Zimmermann does not disclose the details of processing any coin sensor signals derived from its photosensor.

Meyer, U.S. Pat. No. 4,249,648, discloses optical imaging of coins in a bus token collection box in which repeated scanning of chord length of a coin is performed by a 256-element linear light sensing array. Light is emitted through light transmissive walls of a coin chute and received on the other side of the coin chute by the light sensing array. The largest chord length is compared with stored acceptable values in determining whether to accept or reject the coin.

Brandle et al., U.S. Pat. No. 6,729,461, assigned to the assignee herein, disclosed a sensor with both optical and inductive sensors at a coin station within a coin sorting apparatus. Although the hybrid sensor was satisfactory for coin discrimination, it had certain drawbacks. It could not discriminate all of the coins in the Euro coin set, nor could it provide a counting accuracy to an error level of no more than 1:10,000, which is required for coin valuation. Another drawback was that coin dust tended to build up on a sapphire window portion of the optical sensor, thereby interfering with operation of the optical sensor. Still another drawback was manufacturing cost.

Therefore, a new coin counting/discrimination sensor is needed to overcome these limitations.

SUMMARY OF THE INVENTION

The invention relates to a new sensor for rapidly and accurately identifying coins for valuation.

The sensor includes an optical portion that is spaced from a coin track to prevent dust from coins and other sources from accumulating on parts of the optical portion. To provide accurate imaging of the size of the coin from this position, a telecentric lens is employed for receiving light, so that a portion of each coin passing the optical detector is seen to have an apparent size and configuration independent of a variation in distance of the coin from the telecentric lens.

The sensor also preferably uses a reflective principle so as to avoid having to shine light from a source above a coin moving disk of the prior art. As a result of using the reflective principle, the coin moving disk has been modified by providing a recessed portion to allow the reflective portion of the sensor to be positioned above the coin track but underneath the coin moving disk, which no longer needs to be transparent or semi-transparent. This also allows for a narrowing of the width of certain fins of the coin moving disk which now press down on the outer edges of the coins to hold them on a narrow rail of the coin track in a cantilevered position as they move past the optical sensor.

In the reflective system, a further enhancement is provided by angling the optical beam by an angle of about 5 degrees to prevent reflections and diffused light from entering the sensor. In other embodiments, this angle might range from 2 degrees to 30 degrees.

The sensor utilizes an optical imaging sensor to detect coin size, and also utilizes a core alloy sensor, a surface alloy sensor and an edge alloy/thickness sensor to develop multiple parameters for accepting or rejecting a coin. In addition, this sensor utilizes a Hall effect device for sensing the magnetic properties of a coin.

One object of the present invention is to use an optical coin detection sensor that will count the value of coins at a processing rate up to 4500 coins per minute while reducing the need for maintenance over a period of operation.

Other features include providing coatings on the transparent covers for the optical elements to avoid dust collection and also providing a fan to blow dust off the optical sensor area. The dust prevention features are claimed in copending application of the assignee herein, filed on even date herewith and entitled "Method and System for Dust Prevention on an Optical Coin Detection Sensor."

While the present invention is disclosed in a preferred embodiment based on a coin handling machine of Brandle et al., U.S. Pat. No. 6,729,461, the invention could also be applied as a modification to other types of coin handling machines, including the other prior art described above.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention.

DETAILED DESCRIPTION OF THE PREFERRED EMBODIMENTS

Figure 1:
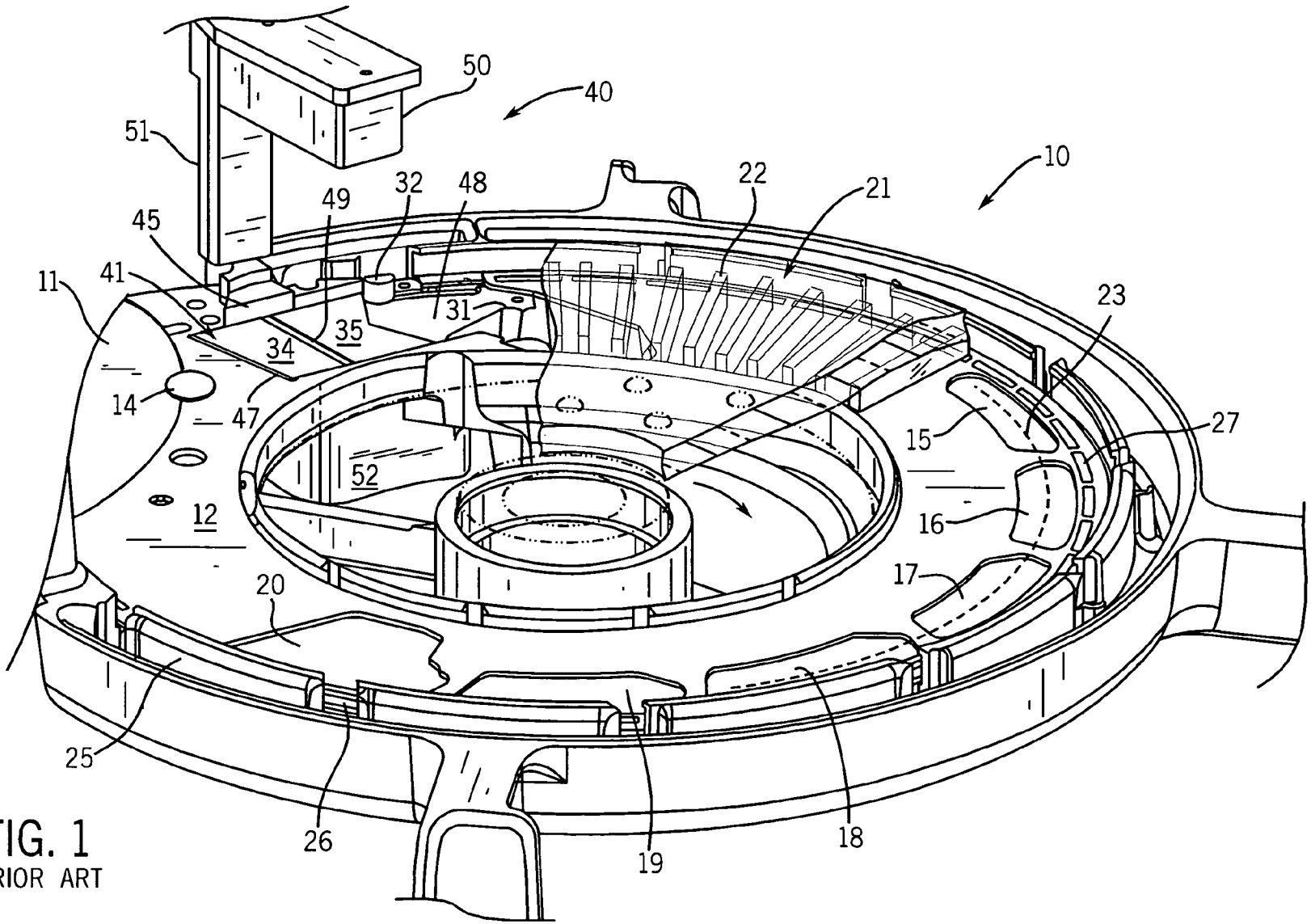
FIG. 1 PRIOR ART
FIG. 1 is a perspective view of a coin handling machine of the prior art.

Referring to FIG. 1, the coin handling machine 10 is a sorter of the type shown and described in Zwieg et al., U.S. Pat. No. 5,992,602, and previously offered under the trade designation, "Mach 12" and "Mach 6" by the assignee of the present invention. This type of sorter 10, sometimes referred to as a figure-8 type sorter, has two interrelated rotating disks, a first disk operating as a feeding disk 11 to separate the coins from an initial mass of coins and arrange them in a single file and single layer of coins 14 to be fed to a sorting disk assembly.

A sorting disk assembly has a lower sorter plate 12 with coin sensor station 40, an offsort opening 31 and a plurality of sorting openings 15, 16, 17, 18, 19 and 20. There may be as many as ten sorting openings, but only six are illustrated for this embodiment. The first five sorting openings are provided for receiving U.S. denominations of penny, nickel, dime, quarter and dollar. From there, the coins are conveyed by chutes to collection receptacles as is well known in the art. The sixth sorting opening can be arranged to handle half dollar coins or used to offsort all coins not sorted through the first five openings. In some embodiments, as many as nine sizes can be accommodated. It should be noted that although only six sizes are shown, the machine may be required to handle coins with twice that number of specifications. The machine can also be configured to handle the Euro coin sets of the EU countries, as well as coin sets of other countries around the world.

As used herein, the term "sorting opening" or "collection opening" shall be understood to not only include the openings illustrated in the drawings, but also sorting grooves, channels and exits seen in the prior art.

The sorting disk assembly also includes an upper, rotatable, coin moving member 21 with a plurality of fins 22 or fingers which push the coins along a coin sorting path 23 over the sorting openings 15, 16, 17, 18, 19 and 20. The coin moving member is a disk, which along with the fins 22, is made of a light transmissive material, such as acrylic. The coin driving disk may be clear or transparent, or it may be milky in color and translucent.

The fins 22 of this prior art device, also referred to as "webs," are described in more detail in Adams et al., U.S. Pat. No. 5,525,104, issued Jun. 11, 1996. Briefly, they are aligned along radii of the coin moving member 21, and have a length equal to about the last 30% of the radius from the center of the circular coin moving member 21.

A rail formed by a thin, flexible strip of metal (not shown) is installed in slots 27 to act as a reference edge against which the coins are aligned in a single file for movement along the coin sorting path 23. As the coins are moved clockwise along the coin sorting path 23 by the webs or fingers 22, the coins drop through the sorting openings 15, 16, 17, 18, 19 and 20. according to size, with the smallest size coin dropping through the first opening 15. As they drop through the sorting openings, the coins are sensed by optical sensors in the form of light emitting diodes (LEDs) (not shown) and optical detectors (not shown) in the form of phototransistors, one emitter and detector per opening. The photo emitters are mounted outside the barriers 25 seen in FIG. 1 and are aimed to transmit a beam through spaces 26 between the barriers 25 and an angle from a radius of the sorting plate 21, so as to direct a beam from one corner of each opening 15, 16, 17, 18, 19 and 20 to an opposite corner where the optical detectors are positioned.

As coins come into the sorting disk assembly 11, they first pass a coin sensor station 40 with both optical and inductive sensors for detecting invalid coins. Invalid coins are offsorted through an offsort opening 31 with the assistance of a solenoid-driven coin ejector mechanism 32 having a shaft with a semicircular section having a flat on one side, which when rotated to the semicircular side, directs a coin to an offsort transition area 48 and eventually to an offsort opening 31 that is located inward of the coin track 23.

The coin sensor station 40 includes a coin track insert 41 which is part of a coin sensor assembly housed in housing 52. This housing contains a circuit module (not seen) for processing signals from the sensors as more particularly described in U.S. Pat. No. 6,729,461.

Under the coin track are two inductive sensors. One sensor is for sensing the alloy content of the core of the coin, and another sensor is for sensing the alloy content of the surface of the coin. This is especially useful for coins of bimetal clad construction. The two inductive sensors are located on opposite sides of a light transmissive, sapphire window element 49.

The coin track insert 41 is disposed next to a curved rail (not shown) which along with edge sensor housing 45 (FIG. 1) forms a reference edge for guiding the coins along the coin track. An edge thickness/alloy inductive sensor is positioned in the edge sensor housing 45 so as not to physically project into the coin track. Referring to FIG. 1, the coin track insert 41 has an edge 47 on one end facing toward the queuing disk, and a sloping surface 48 at an opposite end leading to the offsort opening 31.

A housing shroud 50 is positioned over the window element 49, and this shroud 50 contains an optical source provided by a staggered array of light emitting diodes (LED's) for beaming down on the coin track insert 41 and illuminating the edges of the coins 14 as they pass by (the coins themselves block the optical waves from passing through). A krypton lamp can be inserted among the LED's to provide suitable light waves in the infrared range of frequencies. The optical waves generated by the light source may be in the visible spectrum or outside the visible spectrum, such as in the infrared spectrum. In any event, the terms "light" and "optical waves" shall be understood to cover both visible and invisible optical waves.

The housing shroud 50 is supported by an upright post member 51 of rectangular cross section. The post member 51 is positioned just outside the coin track 23, so as to allow the illumination source to extend across the coin sorting path 23 and to be positioned directly above the window 49.

Figure 2:
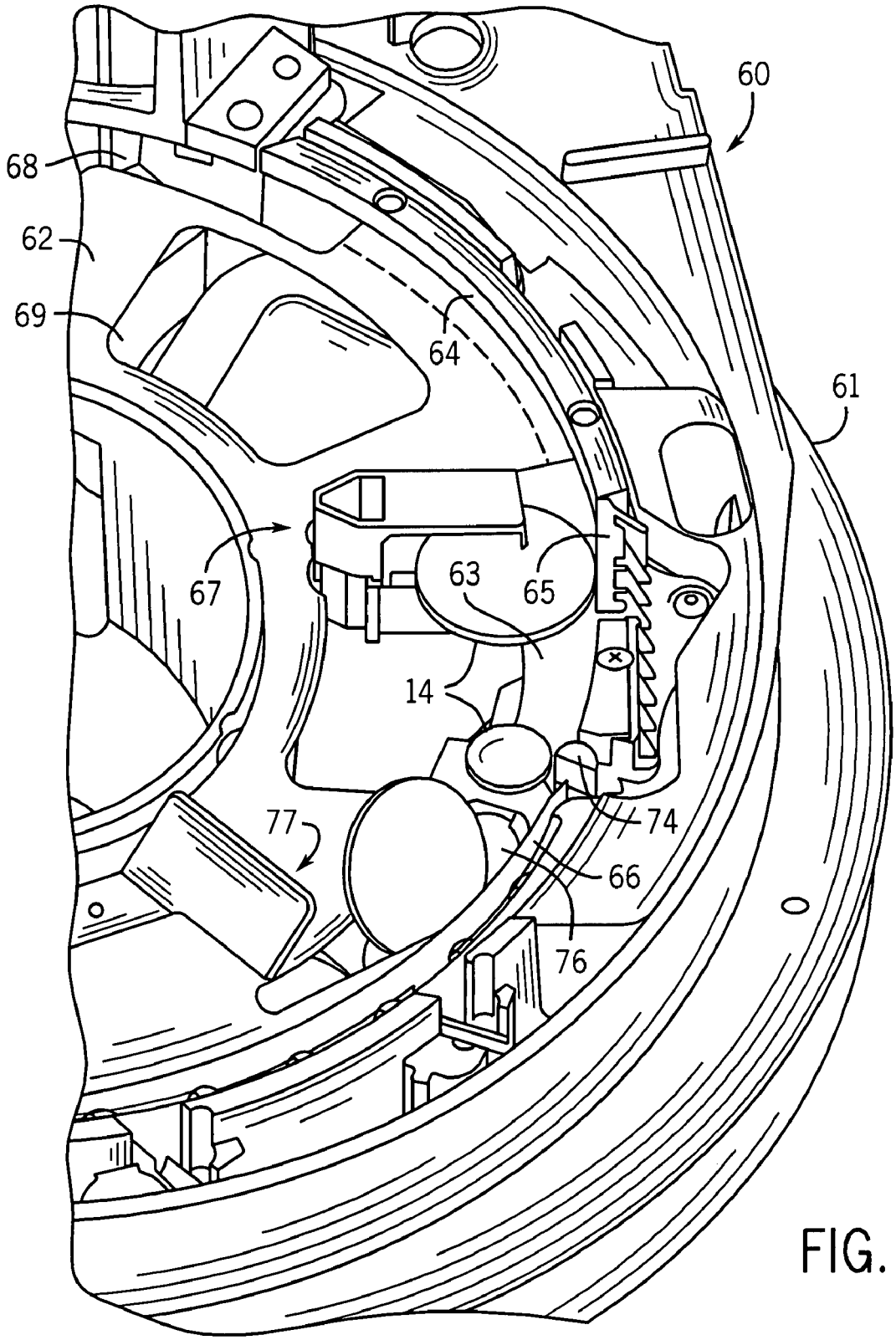
FIG. 2 is a fragmentary perspective view of the coin handling machine of the present invention with parts removed.

Referring now to FIG. 2, in the present invention, a coin handling machine 60 has a dual disk architecture similar to that described above, but has several significant differences.

The new machine 60 is provided in two embodiments, one with sorting openings like the openings 15-20 and another with only a single coin collection opening similar to the largest of the sorting openings 20 seen in FIG. 1. Coins of all denominations are collected through this opening after passing a coin sensor assembly 67 and an offsorting slot 76. In the embodiment in which the coin sensor assembly 67 senses the identity of the coin and there is only one collection opening, the sensors, optical sensors and optical detectors at each opening are not required, with a resulting savings in cost. In single-opening embodiment, the coins are directed to coin bins of a type disclosed in a copending PCT application of Gunst et al., entitled "COIN BIN AND COIN COLLECTING MACHINE," PCT/US07/17969 and designating the United States of America. First, one bin is filled with mixed denominations, and then a second bin is filled with mixed denominations that have been counted and valued using the coin sensor assembly 67 of the present invention to identify each coin.

The present invention is also applicable to an embodiment having coin sorting openings 15-20, either with or without coin detectors at the openings 15-20. In either embodiment, the plane of the sorting plate 62, and thus, the coin track 63, can either be horizontal or angled from horizontal by an amount no greater than thirty degrees, and this shall encompassed by the term "substantially horizontal" in relation to the coin track 63.

Figure 7:
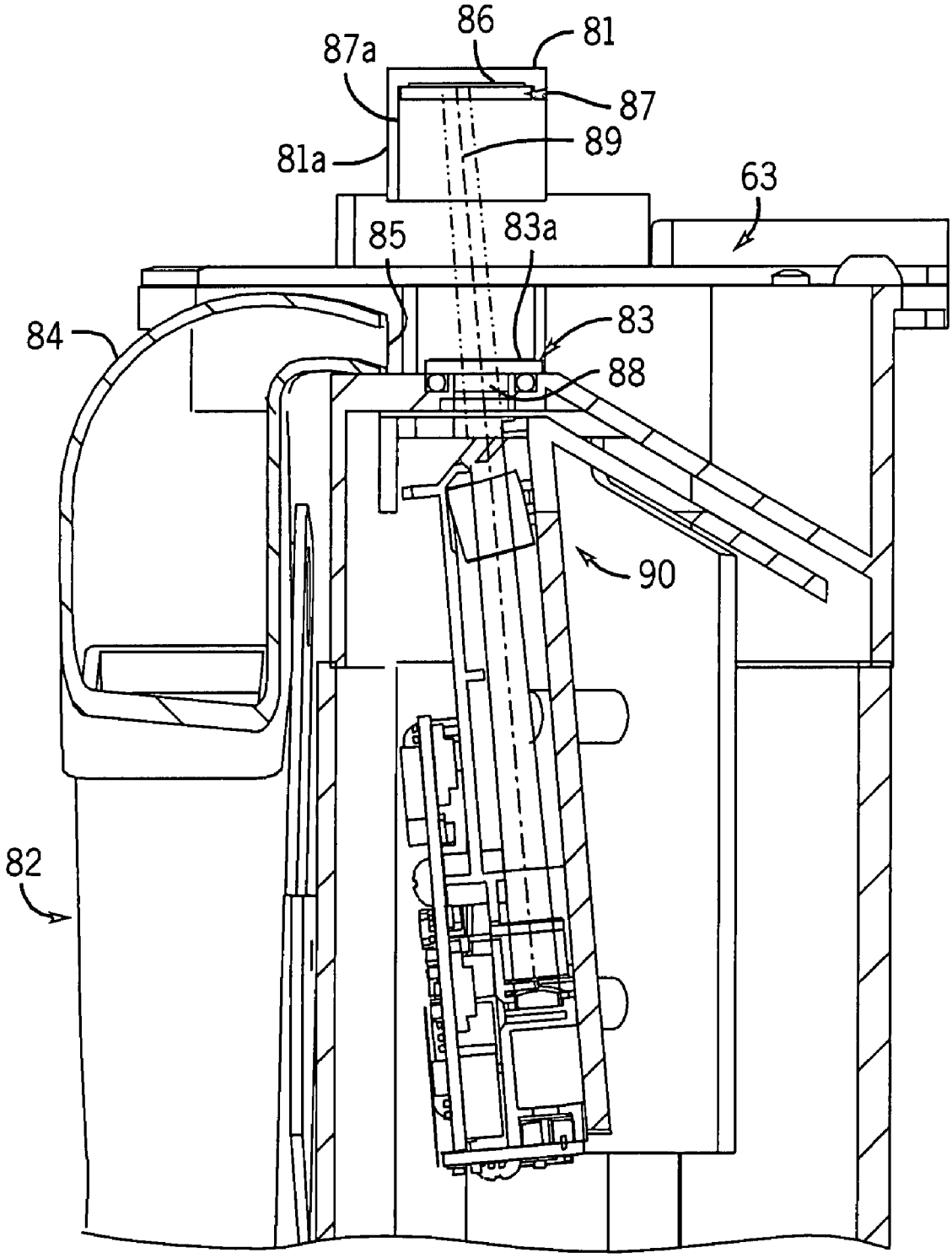
FIG. 7 is a sectional view taken in the plane indicated by line 7-7 in FIG. 6.

The coin sensor assembly 67 will detect a size of an individual coin 14 in a plurality of coins being moved within a coin handling machine 60 and will also detect and offsort invalid coins moving through the coin handling machine 60. The coin handling machine 60 has a base member 61 for supporting a sorting plate 62 having a coin track 63 passing along an outside reference edge 64, 65, 66 for the coins that is formed by base member arcuate portion 64, an edge sensor assembly 65 and an upstanding rail 66. Some additional offsorting slots 68, 69 and 70 have been provided for coins not in position along the reference edge. A coin sensor assembly 67 now includes a reflective-type optical sensor and is positioned to the inside of a coin track 63, ahead of the coin sorting slots (not seen in FIG. 2). The light source is now positioned lower than the coin track 63 rather than above it for illuminating at least portions of the coins as the coins move along the coin track 63. As seen in FIG. 7, the shroud portion 81 of the coin sensor assembly 67 has a reflector 86, 87 on its underside positioned above the coin track 63. An optical detector is located on a circuit board 95 (FIGS. 8 and 9) that is positioned below the cover 83 for the sensor 90 for detecting a size of at least a portion of each coin 14 passing the coin sensor 67 along the coin track 63. A telecentric lens 94 (FIG. 8) is positioned between the optical detector circuit board 95 and the coin track 63, such that the portion of each coin passing the optical detector circuit board 95 is seen to have an apparent size and configuration independent of a variation in distance of the coin from the telecentric lens as each coin moves along the coin track.

Figure 4:
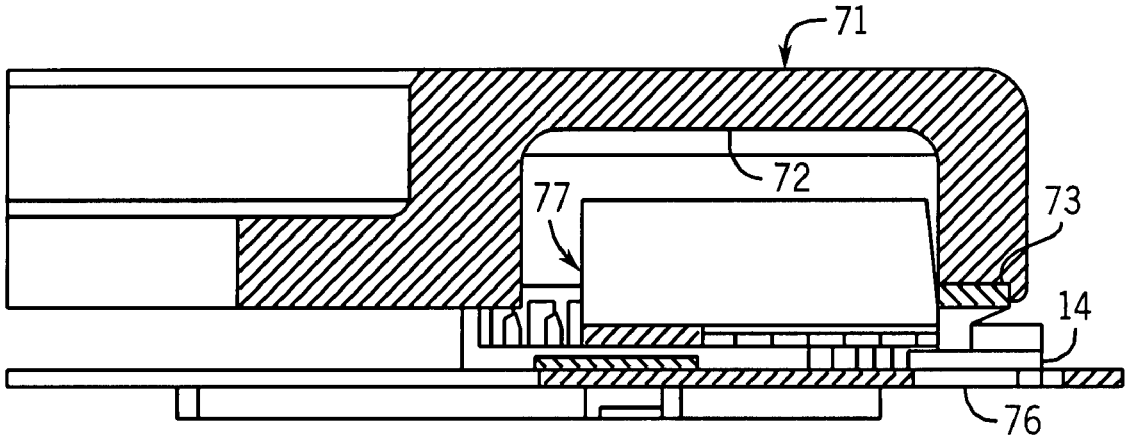
FIG. 4 is a detail sectional view of a portion of the apparatus seen in FIG. 3.

In an alternative embodiment, the reflector 86, 87 can be provided by a reflective strip of material in cavity 72 seen in FIG. 4. A brush can be installed along the path of rotation of the disk 71 to brush dust off the reflective portion of the disk 71.

Figure 3:
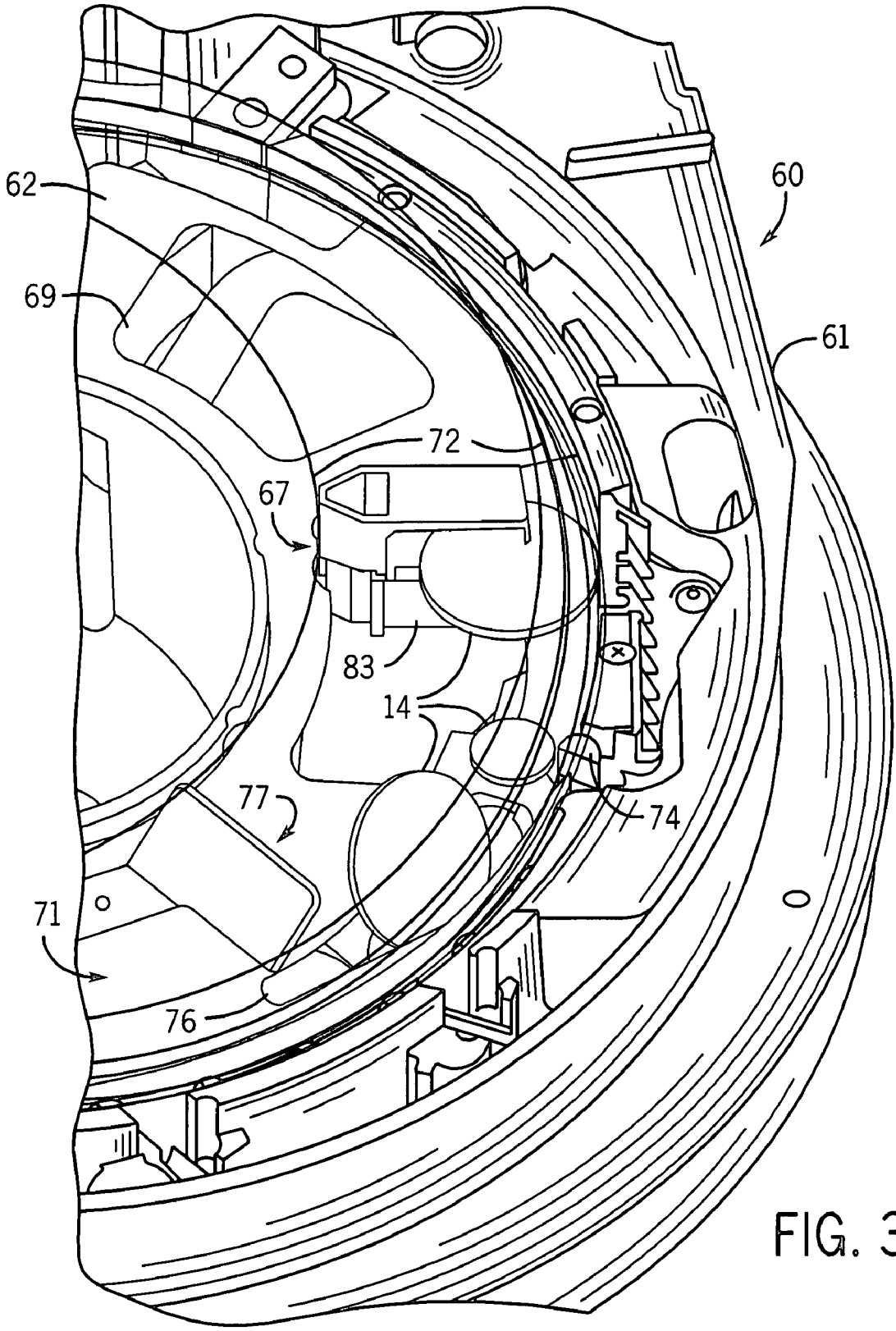
FIG. 3 is a second fragmentary perspective view of the coin handling machine of the present invention with parts made transparent.

The feeding disk 11, in conjunction with features of the sorting assembly, feed the coins onto the coin track 63 in a single layer and in a single file in a manner known in the prior art. FIG. 3 shows that the coin moving disk 71 has been modified to provide a recess 72 (see also FIG. 4) for allowing the coin moving disk 71 to pass over the top of the coin sensor assembly 67 and to pass by the coin sensor assembly 67 on opposite sides. The coin moving disk 71 is shown as transparent for illustration purposes only, and in practice can be transparent, semi-opaque or opaque as there is no longer a requirement to shine a light source through the coin moving member 71. The fins or fingers 73 (see also FIG. 4) of the coin moving disk 71 have been made much narrower than in the prior art and now press down on the outside portions of the coins 14 near the reference edge.

This has the effect of tipping up the inside edges of the coins 14 off the coin track 63, as seen in FIGS. 2 and 3, so that the coins are cantilevered over the inside edge of the coin track 63. The coin moving disk 71 is operable to move the coins along in single file at a rate up to 4500 coins per minute.

The machine 60 has an offsorting arrangement including an offsorting slot 76, a deflector 77 and a solenoid-driven coin diverter 74, all of which are more fully described in a copending U.S. application filed on even date herewith, and entitled "Method and Apparatus for Offsorting Coins in a Coin Handling Machine," the disclosure of which is hereby incorporated by reference. This is for offsorting coins that are detected as invalid by the coin sensor assembly 67.

Figure 5:
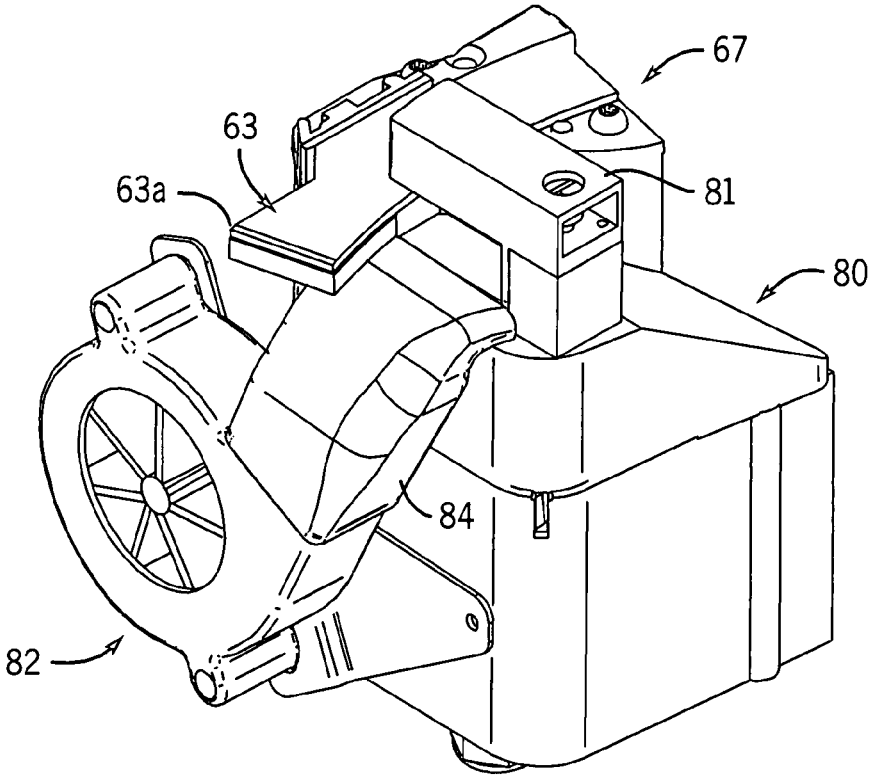
FIG. 5 is a rear perspective view of a sensor assembly of the present invention.
Figure 6:
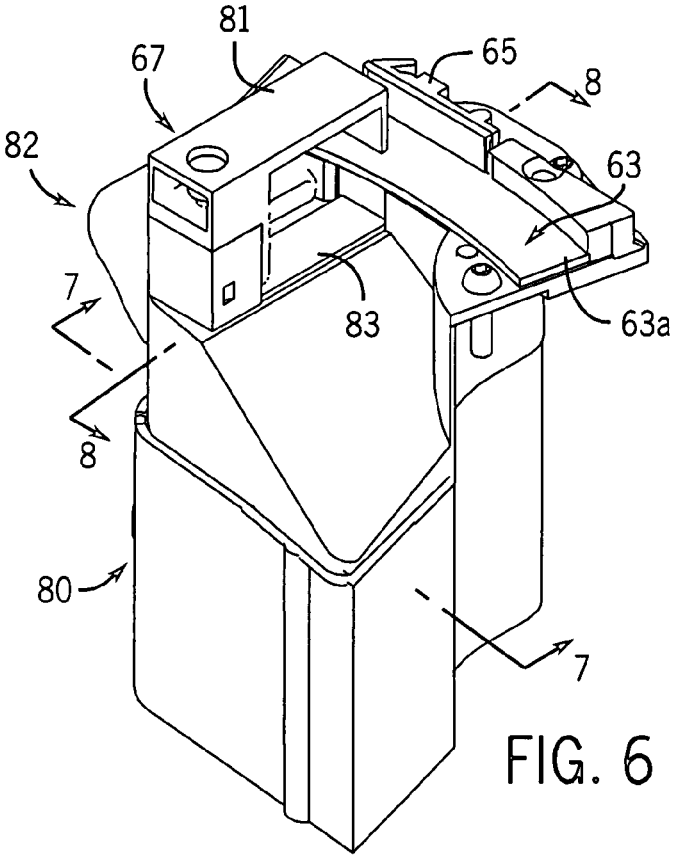
FIG. 6 is a front perspective view of the sensor assembly of FIG. 5.

FIGS. 5 and 6 show the coin sensor assembly 67 which has been removed from the sorting assembly. The portion of the coin track 63, which is part of the sensor assembly 67, has a layer of zirconia ceramic 63*a* to provide wear resistance. The coin sensor assembly 67 assembly is contained in a housing 80. Extending above the housing 80 is a housing shroud 81, which is positioned above a lower transparent cover 83 that covers a slot opening 88 for an optical sensor and detector 90 seen in FIG. 7. The shroud 81 includes a depending skirt 81*a* for blocking dust from entering the area of the lower cover 83. In FIG. 5, a fan unit 82 has been added to blow coin dust off of the lower cover 83. The fan unit 82 has a duct 84 with an opening 85 closely adjacent the cover 83 as seen in FIG. 7. As further seen in FIG. 7, the inside of the housing shroud 81 contains a reflector provided by a sheet of reflective material 86 and an upper transparent cover 87. This reflector is positioned over the slot opening 88 to the optical sensor and detector 90 including a positioning above an inside edge of the coin track. The illumination source in the optical sensor and detector 90 is positioned to send provides parallel beams of light through the slot opening 88 to the undersides of coins and to the inside edge of the coin track 63. The optical sensor and detector assembly 90 includes a linear diode array 115 on a circuit board 95 shown in FIG. 9. The circuit board 95 further includes a processor 111 (FIG. 14) for receiving signals from the optical detector 115 and for producing size data to be transmitted to a machine controller 120 (FIG. 14) of the type disclosed in Brandle et al., cited above, for accumulation of coin values and display of totals.

The coin track 63 is elevated above the lower transparent cover 83 by a spacing in a range from 0.1 cm to about 5 cm. The reflector 86, 87 is spaced above the coin track 63 in a range from 2.5 cm to about 7.5 cm. This spacing aids the prevention of coin dust on the coin track 63.

Besides the coin track 63, other elements of the coin dust prevention system include upper and lower spaced apart transparent optical elements for illuminating a portion of a coin as a plurality of coins move along a coin track in single file. In a more particular feature of the coin dust prevention system that the lower optical element provides for transmission and reception of illumination to and from the coin 14, while the other element 86, 87 provides for optical reflection. It is a more particular feature illustrated in FIG. 7 that the covers 83 and 87 for the optical elements are each made of glass and provided with an electrically grounded, conductive coating 83*a*, 87*a*, preferably a indium-tin oxide, to neutralize any static electrical charge that would assist dust attraction and accumulation. The covers 83 and 83 contact the housing 80 for the sensor assembly, which is also made of conductive plastic material that is connected to ground represented schematically in FIG. 6. It is still another feature of the dust prevention system, as shown in FIG. 7, that a fan 82 is positioned adjacent the lower optical element for blowing coin dust off the cover 83 during operation of the coin handling machine 60.

Figure 8:
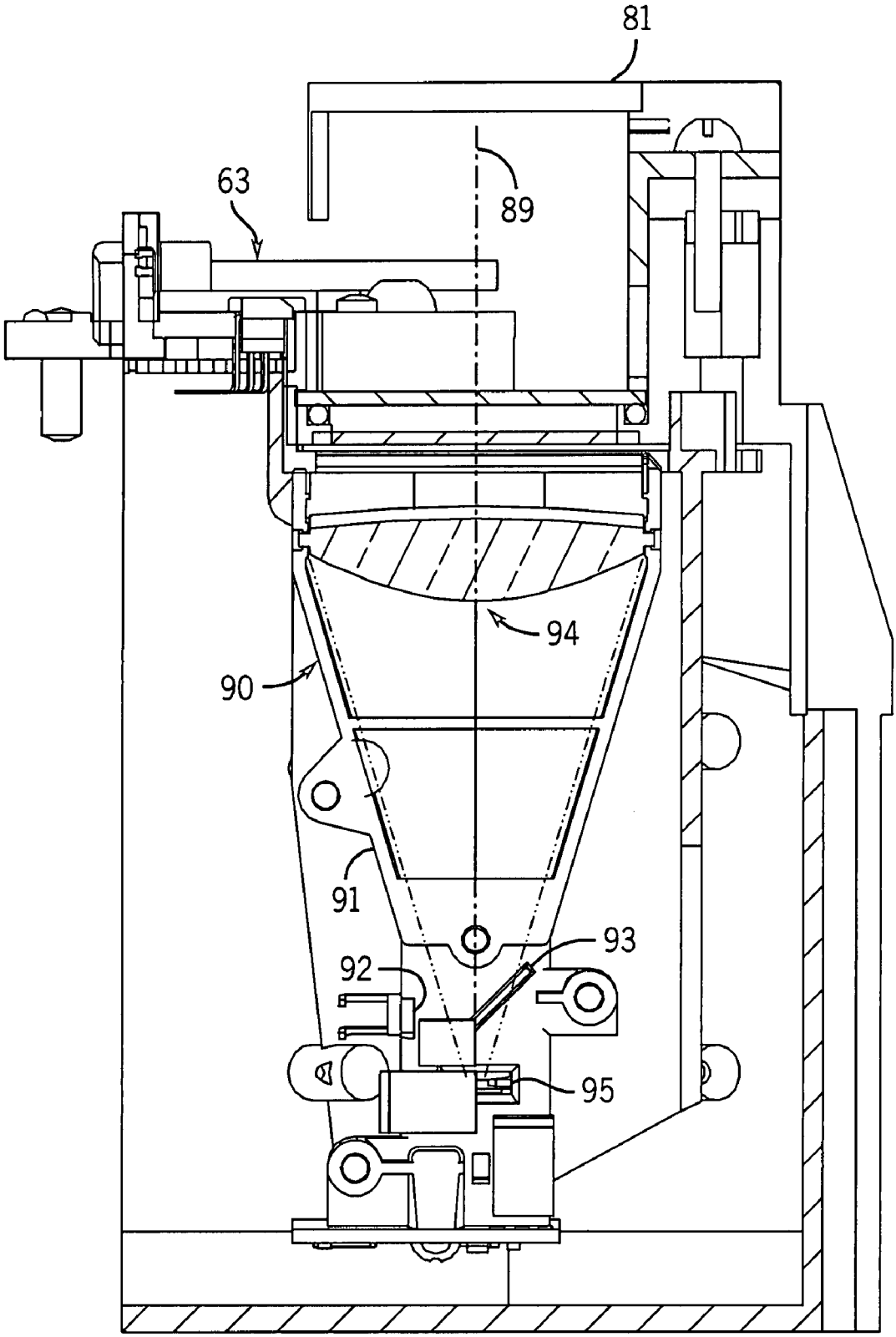
FIG. 8 is a sectional view taken in the plane indicated by line 8-8 in FIG. 6.
Figure 9:
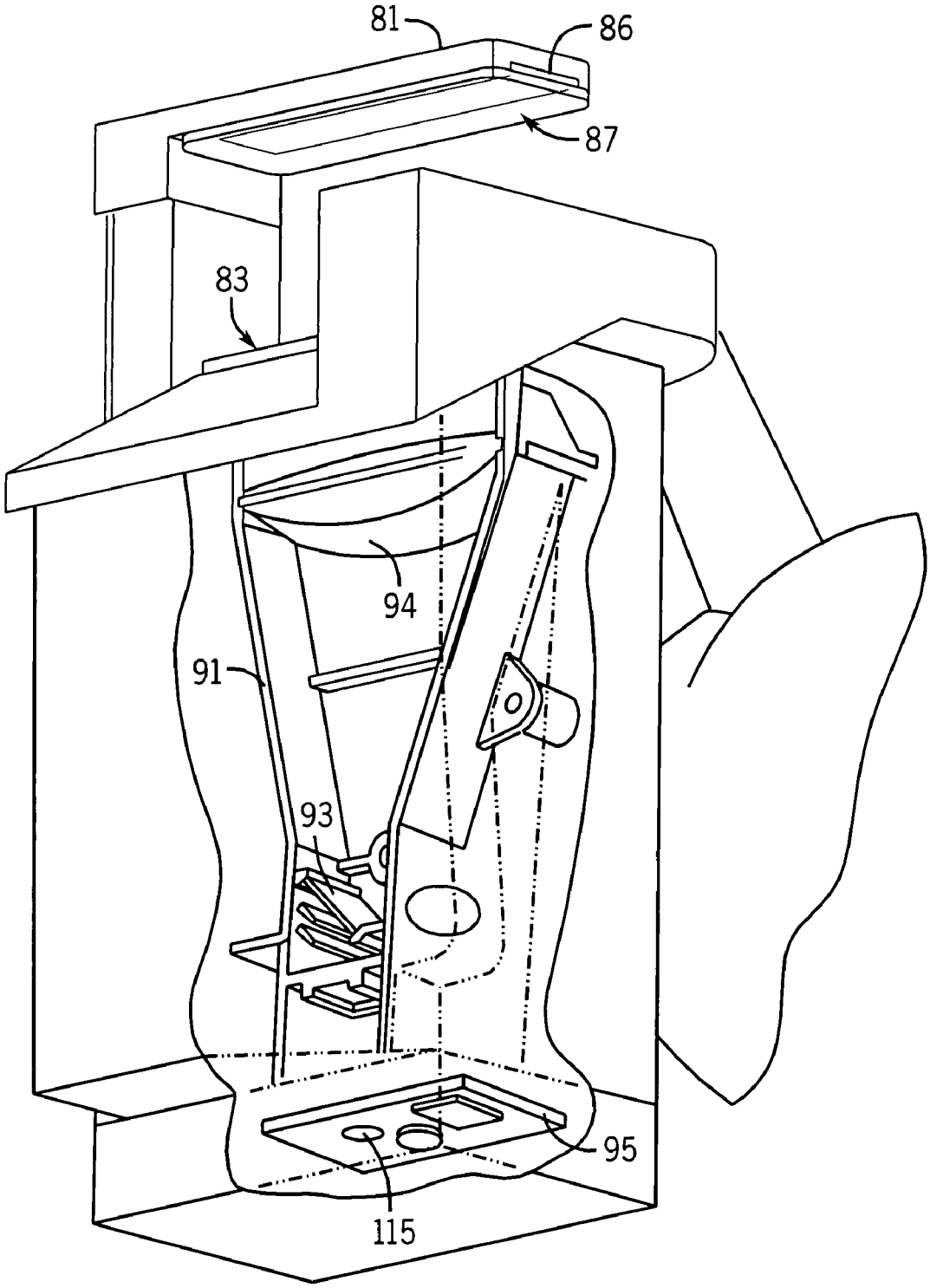
FIG. 9 is a front perspective view of a sensor assembly of the present invention with parts broken away for a view of internal parts.

The details of the optical sensor and detector assembly 90 are illustrated in FIGS. 7, 8 and 9. The telecentric lens 94 is mounted in a framework 91. A source 92 of LED illumination is mounted in the framework 91 to direct illumination to a reflective and refractive element 93 that will reflect light upwardly along axis 89 and through slot 88 and transparent member 83 seen in FIG. 7. From there, it will travel to the reflector 86, 87 unless blocked by a portion of a coin 14. After reflection, the light will travel back along the axis 89 to reflective and refractive element 93, but this time the light will pass through the element 93 rather than being reflected, and it will travel to the detector on the circuit board 95.

As seen in FIGS. 7 and 8, the telecentric lens 94 can be disposed on an axis 89 that is at an angle in a range from two degrees to thirty degrees from vertical, so as to block reflections from the cantilevered portions of the coins 14. The telecentric lens 94 in FIGS. 7 and 8 is more actually disposed on an axis that is at an angle of five degrees from vertical.

Referring to FIGS. 10A-10F, alloy detection is based on two inductive coils 98, 99 with a diameter of D=5.6 mm for the determination of the core and surface alloy. The coils 98, 99 are excited with a first frequency of 160 kHz for the core alloy sensor 98 and a second frequency of 950 kHz for the surface alloy sensor 99. To pick up the magnetic property of the coin, a Hall effect sensor 97 is chosen and placed just beside the coils 98, 99. Another coil 65*a* is positioned in the rail 65 to measure the thickness of the coin, wherein the thickness measurement is also dependent on the edge alloy of the coin. A linear optical detector 115 in the located below a slot opening 88 senses the diameter and is also used for triggering the different coin positions.

The optical sensor and detector assembly 90 is a customized version of a sensor available under the trade name "Parcon" from Baumer Electric AG, Frauenfeld, Switzerland. The sensor produces an almost parallel IR beam, that leaves the sensor, is reflected by a reflector and comes back to the sensor almost parallel. It is then focused on a detector in the form of a linear diode array with 128 pixels. The efficiency of the reflector is such that illumination times of less than 0.1 ms are achievable. A microelectronic CPU 111 reads through all the pixels and then determines the edge of the object. It also performs some interpolation between pixels to get a higher resolution. Nominal resolution is 1 pixel which equals 0.2 mm in distance. Interpolation within ½-¼ pixel is possible which means a resolution in the range of 0.1-0.05 mm.

There are two definitions of system speed for this sensor:

1. 4500 coins of 17 mm (radius)/1 minute=>2550 mm/s
2. 19.37 rad is at 153 mm radius=>2963 mm/s The sensor resolution is about 0.1 mm.

When the coin passes the sensor 90 the maximum value determines the coin diameter. The sensor 90 is enough to capture the maximum diameter or within an allowable tolerance.

Figure 10A:
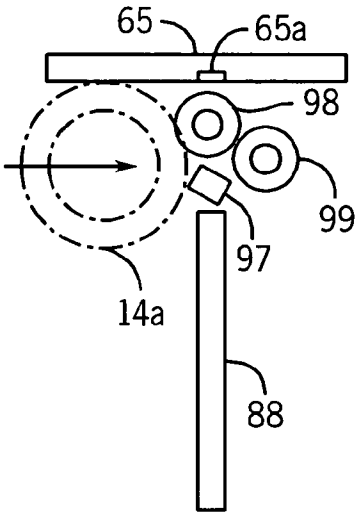
FIGS. 10A to 10F are schematic diagrams showing the operation of the optical, alloy and Hall effect sensors in identifying a large coin.
Figure 10B:
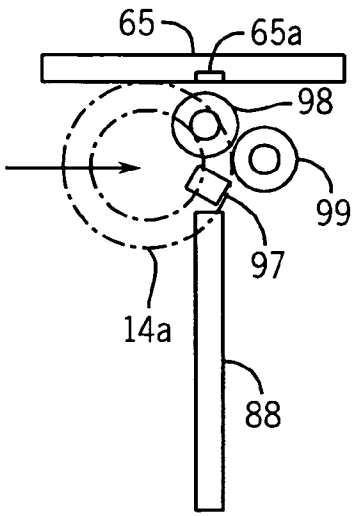
Figure 10C:
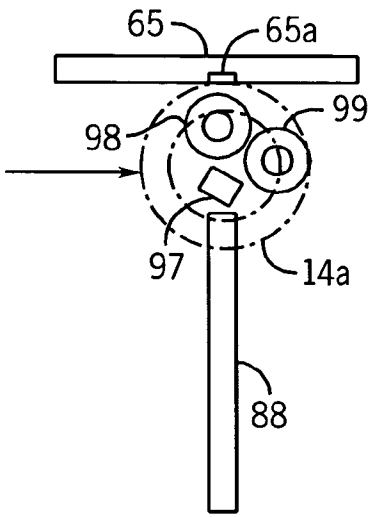
Figure 10D:
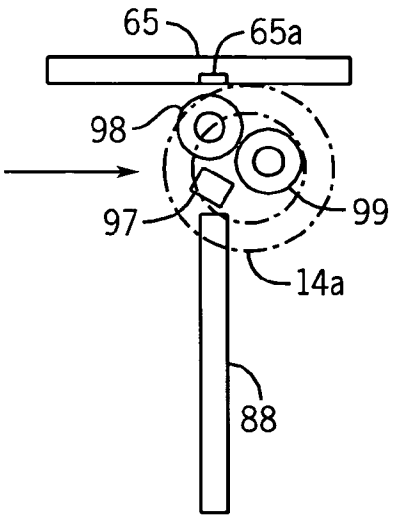
Figure 10F:
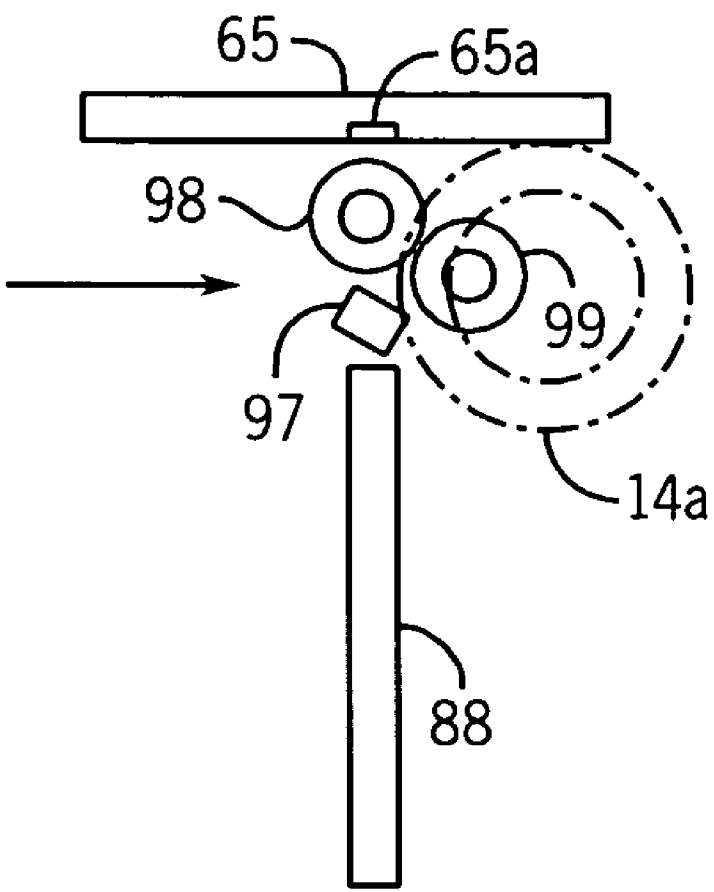
Figure 10E:
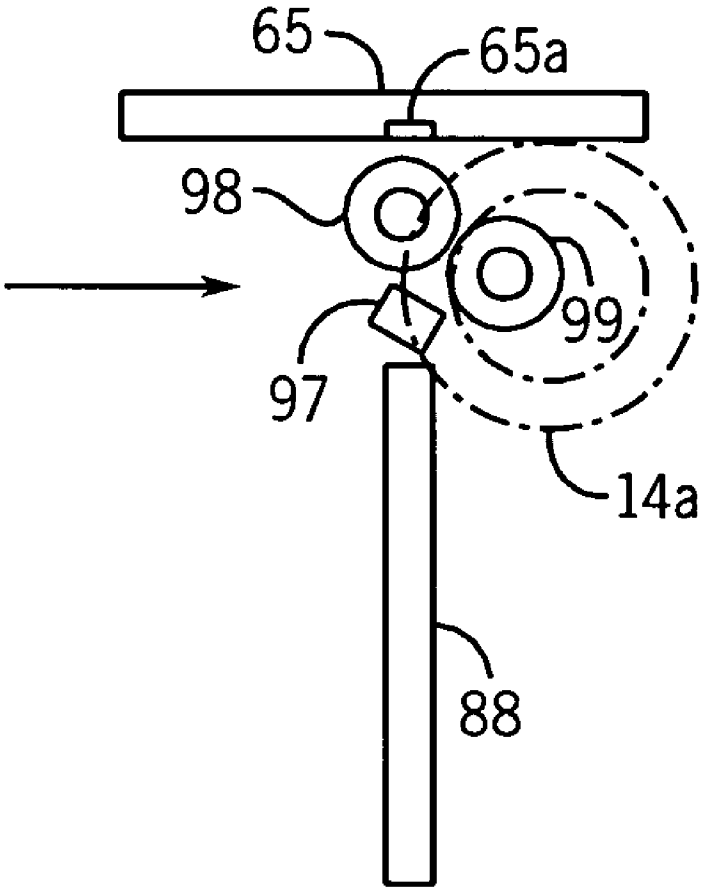
Figure 12:
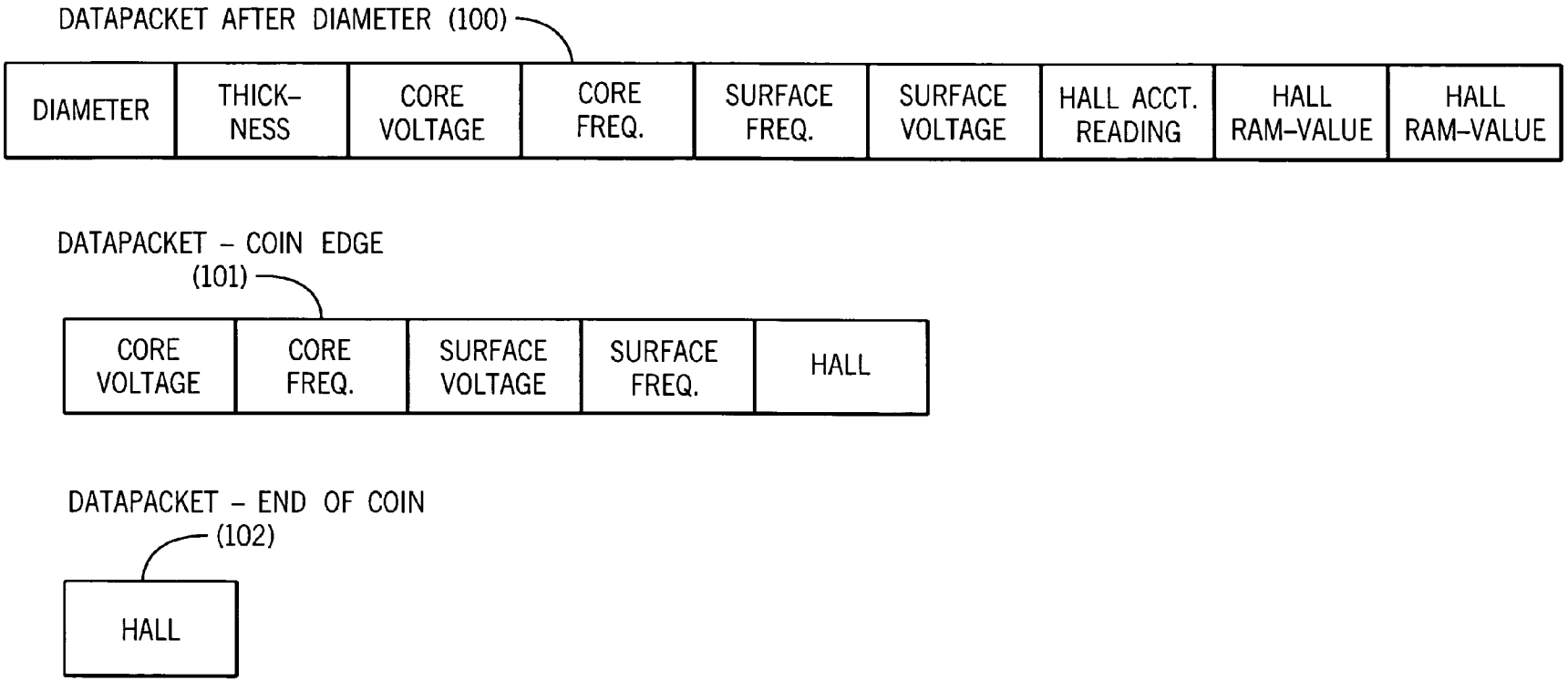
FIG. 12 is map of the data packet transmitted by the sensor assembly to a machine controller.
Figure 13:
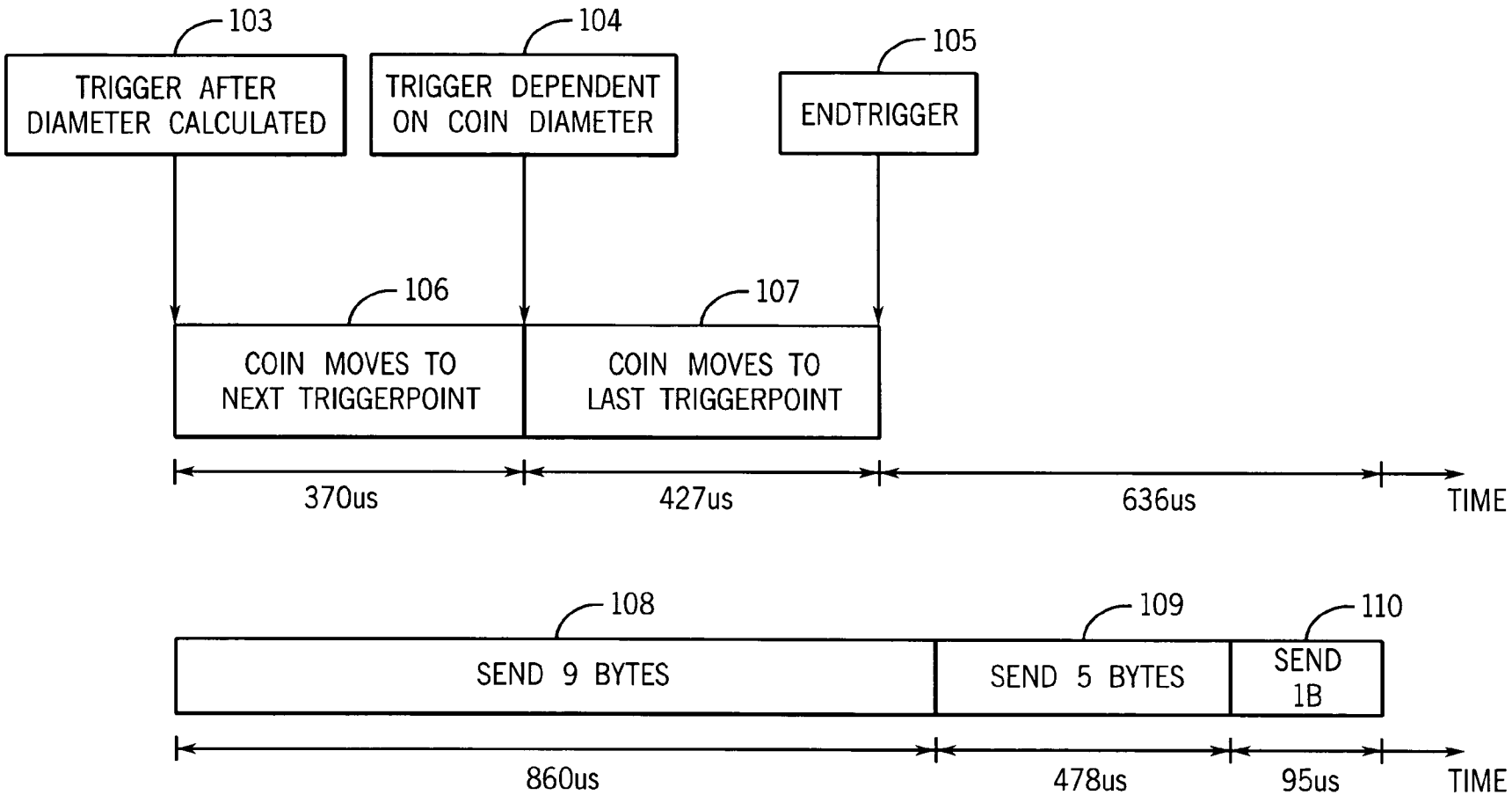
FIG. 13 is a timing diagram showing the data transfer from the sensor assembly to a machine controller.

As seen in FIG. 10A, the start position is detected when the coin 14*a* runs into the optical detection range represented by the slot opening 88. The measurement cycle for each coin starts at this position. Data from the Hall effect sensor 97 are continuously read out through the positions in FIGS. 10B and 10C and are buffered to a memory on the circuit board 95 (FIG. 9). As soon as the sensor assembly 90 is able to calculate the diameter of the coin 14*a* in FIG. 10D (also represented by block 103 in FIG. 13), the next trigger is set (as represented by block 106 in FIG. 13) and the thickness and alloy measurements including the actual reading of the Hall effect are obtained and processed according to the diameter sensed for the coin (as represented by block 104 in FIG. 13). The coin then moves onto the last trigger point shown physically in FIG. 10F and schematically as block 105 in FIG. 13. A data stream, as mapped in FIGS. 12 and 13 is transmitted through the serial data link 113 (FIG. 14) to the machine controller in three time slots 108, 109, 110 (FIG. 13). The data bytes in these packets 100, 101 and 102 are mapped in FIG. 12.

Figure 11A:
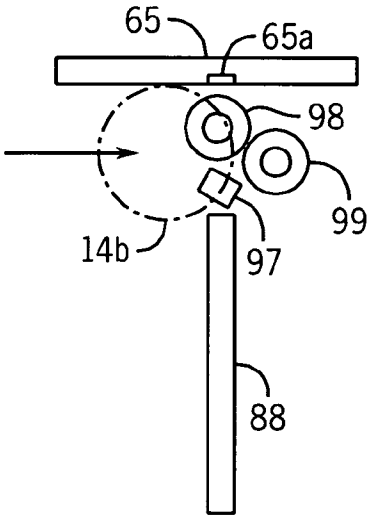
FIGS. 11A to 11D are schematic diagrams of the operation of the optical, alloy and Hall effect sensors in identifying the smallest coin.
Figure 11B:
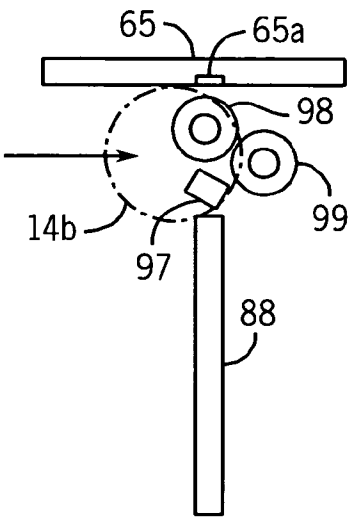
Figure 11C:
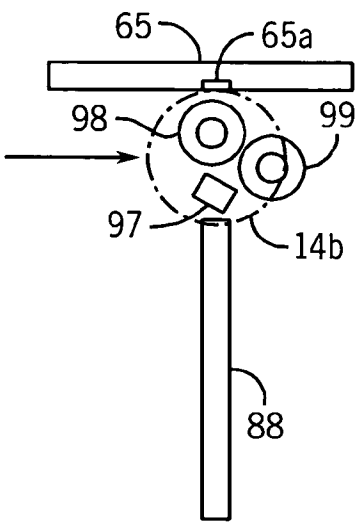
Figure 11D:
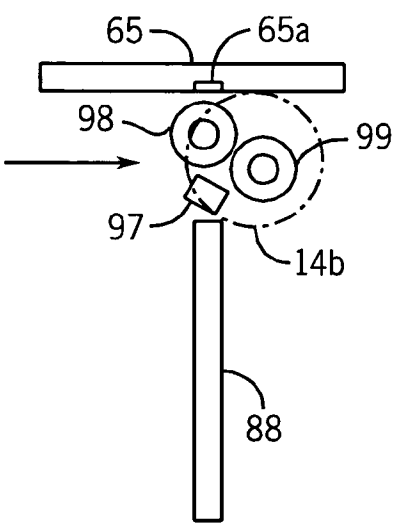

FIGS. 11A through 11D show the case for smaller coins 14*b*. Here FIG. 11A corresponds to FIG. 10A for the larger coins 14*a*. FIGS. 11B through 11D correspond to FIGS. 10D through 10F for larger coins. There are no Hall data collection points corresponding to FIGS. 10B and 10C for smaller coins 14*b*. The data stream is simply filled up with the "Hall Act. Reading" of the diameter trigger, because the Hall effect sensor data are not containing any further information of the coin. The accumulated RAM values of the Hall effect sensor 97 are rejected in this case. The third trigger position in FIG. 11C is coin dependent and is calculated based on the measured diameter. This provides readings from the edge of the coin. The end position of the coin is the location where the coin does not cover the optical detection slot 88 anymore as seen in FIG. 11D.

The first data packet 100 (FIG. 12) is transmitted right after the diameter of the coin is detected. Assuming a maximum speed of $v_{max}$=3 m/s, the time the coin takes to the following trigger position is dt=370 μs. To the last trigger-point it takes 427 μs. The time it takes for sending all the readings through the serial link is 1.433 ms at a data rate of 115.2 kBaud. The time of 636 μs that the sensor needs to finish data transfer is less than the time it would take to send new data from the following coin.

This sensor concept acquires only a minimum of coin data that are necessary to assess a coin. Even at maximum speed of 3 m/s it works well using an asynchronous serial link at a data rate of 115.2 kHz. Readings of a center part and an outer ring for a possible 2 Euro and 1 Euro coin are taken, and furthermore two additional items information of the coin are taken with the Hall effect sensor. This should help to identify and offsort counterfeit coins. The concept is optimized relating to constant readings per coin and the asynchronous serial link of 115.2 kBaud.

Figure 14:
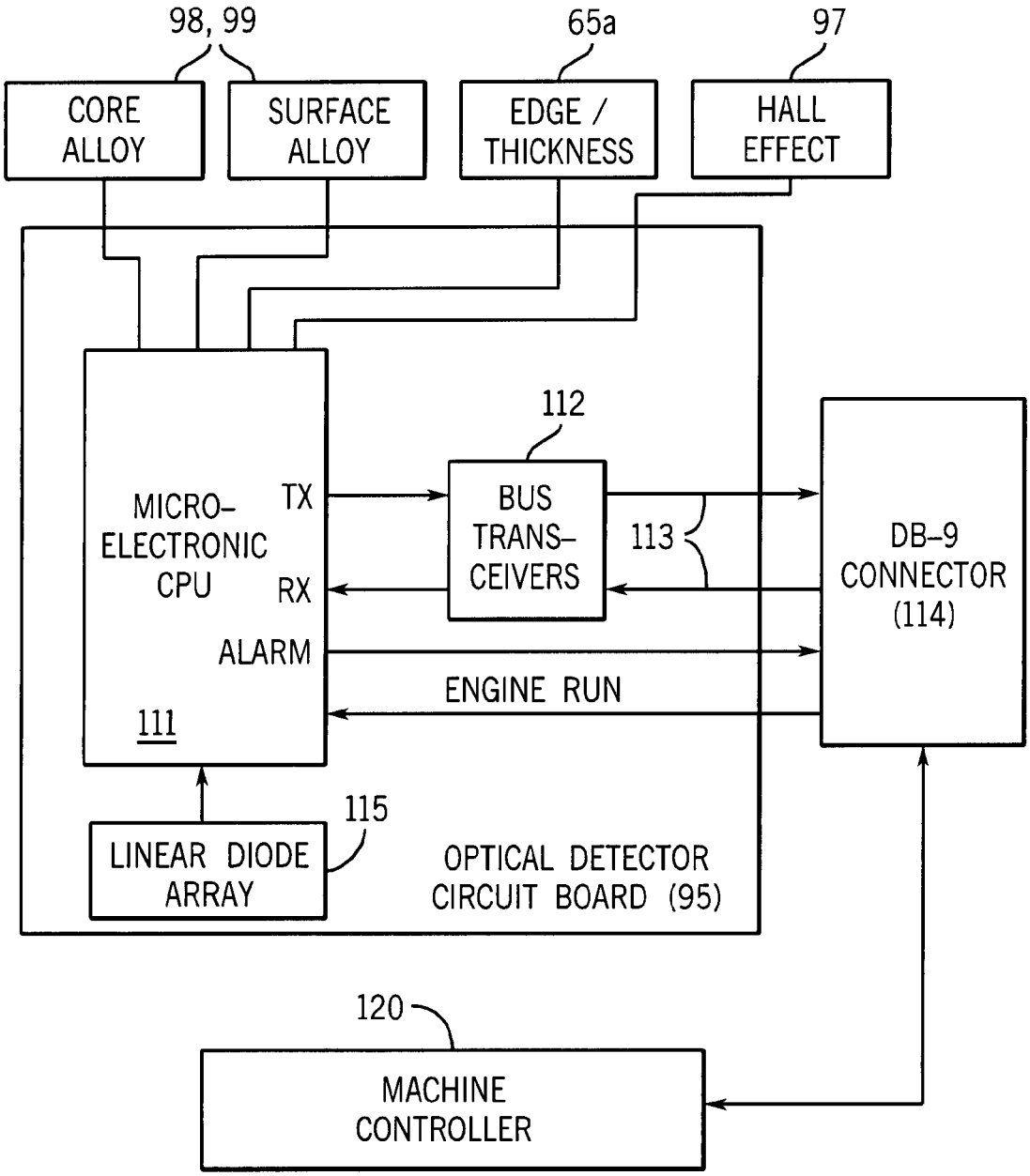
FIG. 14 is a block diagram of the electronics in the sensor assembly of FIGS. 6-9 and a machine controller.

The details of the optical detector circuit board 95 are shown in FIG. 14. A microelectronic CPU 111 receives inputs from the alloy, Hall effect and edge sensors 65*a*, 97, 98 and 99. It performs computations and transmits the data seen in FIG. 12 to a machine controller through a serial bus 113 have transmit (TX) and receive (RX) portions. The serial bus 113 is connected through bus transceivers 112 of a type common in the art to a DB-9 serial data link connector 114 to a machine controller 120 outside the sensor module assembly 67. One line is utilized for an ENGINE RUN signal that is received by the CPU 111, when the main motor of the machine is running under power. One line is also used for an ALARM signal to the machine controller 120. The detector is a linear diode array 115 that provides its data to the CPU 111 for the coin size determination.

Figure 15:
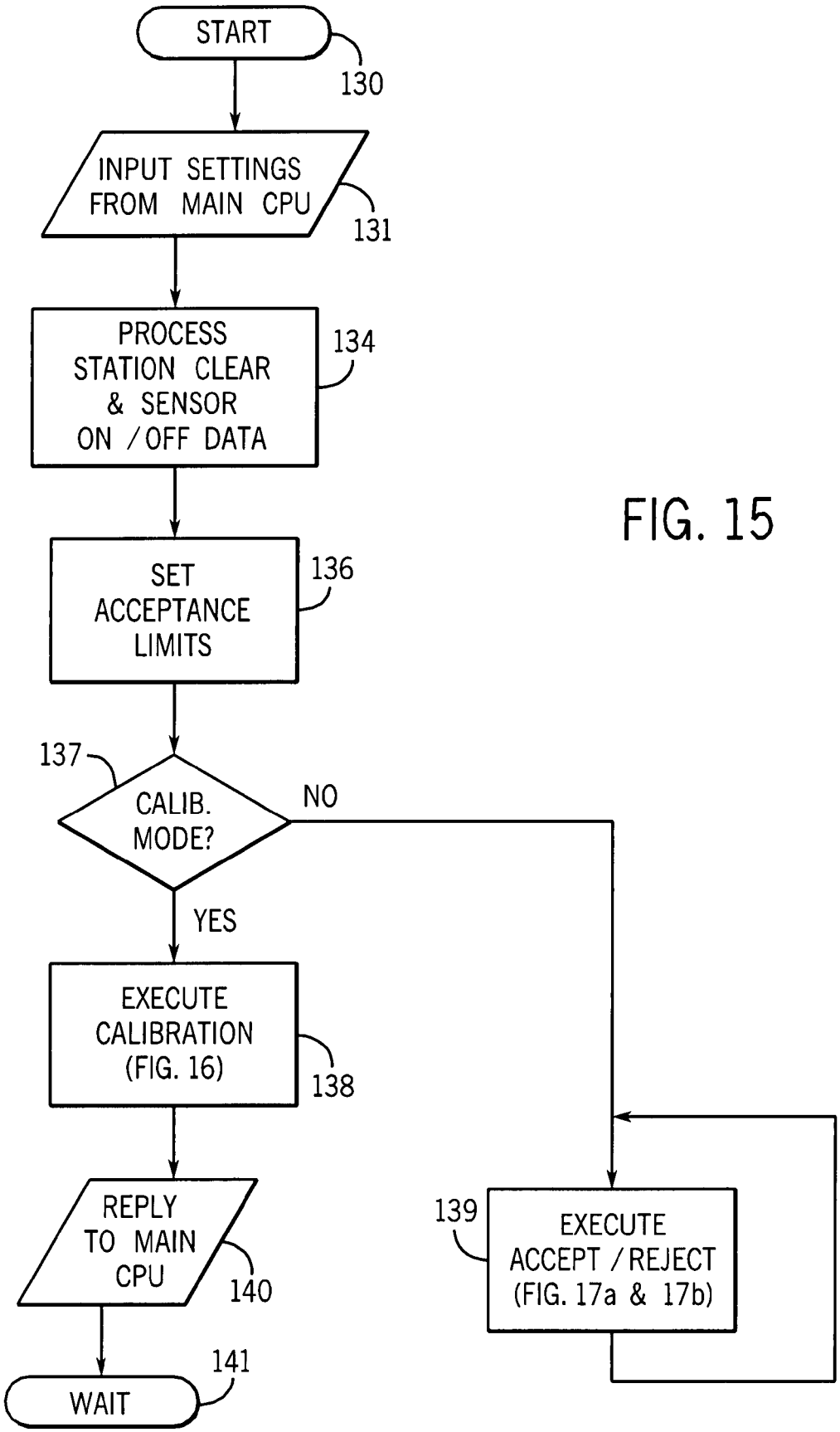
FIGS. 15, 16, 17*a* and 17*b* are flow charts of the operation of the machine controller according to a program of instructions to identify and count coins for valuation.

Referring next to FIG. 15, a main loop, startup routine for the operation of a microelectronic CPU in the machine controller 120 is charted. The operations are carried out under program instructions. The start of this portion of the operations is represented by the start block 130. Next, as represented by input block 131, the main controller reads in operator settings, which are entered through a user interface for the coin sorter 60. These settings include sensitivity settings for at least sixteen stations or alloy specifications, with five sensors per station (size, thickness, surface alloy, core alloy and Hall effect magnetic properties) for a total of eighty data sets with plus and minus settings for a grand total of one hundred and sixty (160) data sets. In other embodiments of the invention, the number of coin-alloy specifications may be expanded up to greater numbers.

As represented by process block 134, a matrix of data structures representing the sixteen (16) stations (coin denomination/alloy specifications) with five sensors each is checked to see if any station has been cleared during the calibration routine, meaning that it is not in use as represented by zeroes in its five sensor data locations in the matrix. Also, each sensor is checked within each station to see if it should be "ON" or "OFF".

Then, a microelectronic CPU in the main controller 120 executes instructions represented by process block 136 to set up acceptance test limits for each coin denomination/alloy specification for each sensor that is "ON", including size, surface alloy, core alloy and edge thickness. This allows the operator to adjust coin sensitivity without changing original calibration values.

Where a parameter, such as coin size or edge thickness has a single value, limits can be set up by using the sensitivity settings to determine a range plus (+) and minus (−) from a single average value calculated for a specific coin denomination and alloy specification based on a thirty-coin sample run. In the case of two-variable parameters, represented by core alloy composition and surface alloy composition, a "least squares" method is used to fit a curve to the two-dimensional plot of data points for a calibration run of 32 coins. The curve has a slope, A, an axis-intercept B, and a Δ factor according to the following equations:

$$A=(n*\Sigma x*y-(\Sigma x)*(\Sigma y))/\Delta) \quad 1)$$

$$B=((\Sigma x*x)*(\Sigma y)-(\Sigma x)*(\Sigma x*y))/\Delta \quad 2)$$

$$\Delta=n*\Sigma x*x-(\Sigma x)^2 \quad 3)$$

When thirty-two readings of voltage and frequency for a surface alloy, for example, are plotted on an x-y graph, it produces a field of points. Using the above equations, a curve is determined for use as baseline for calculating a lower acceptance limit and an upper acceptance limit, as represented by process block 136. The acceptance test limits in the y-direction become a range of values above and below this curve based on the sensitivity settings entered by the operator and read in input block 131. The acceptance test limits in the x-direction are limited by the end points of the curve.

Figure 16:
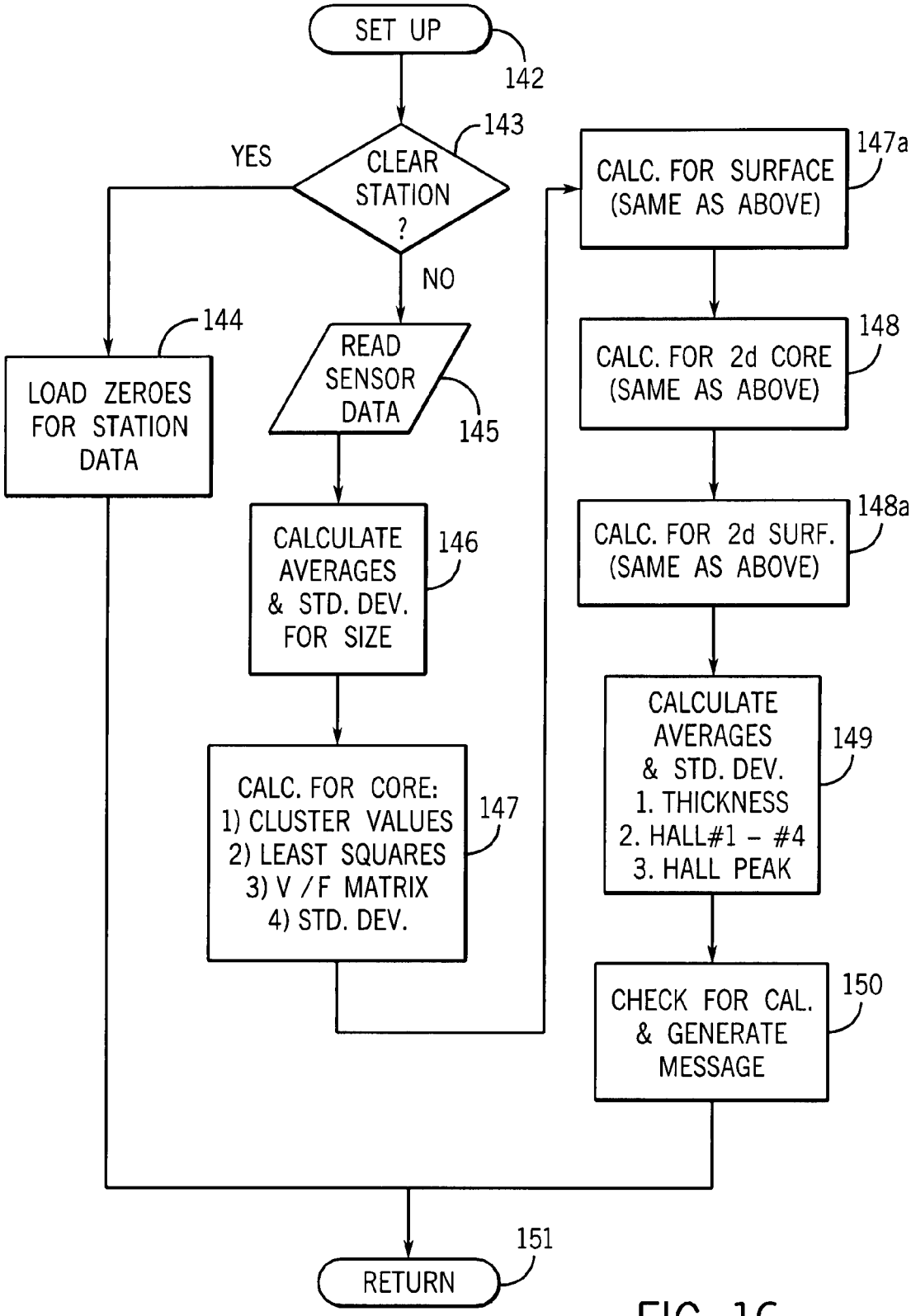
Figure 17A:
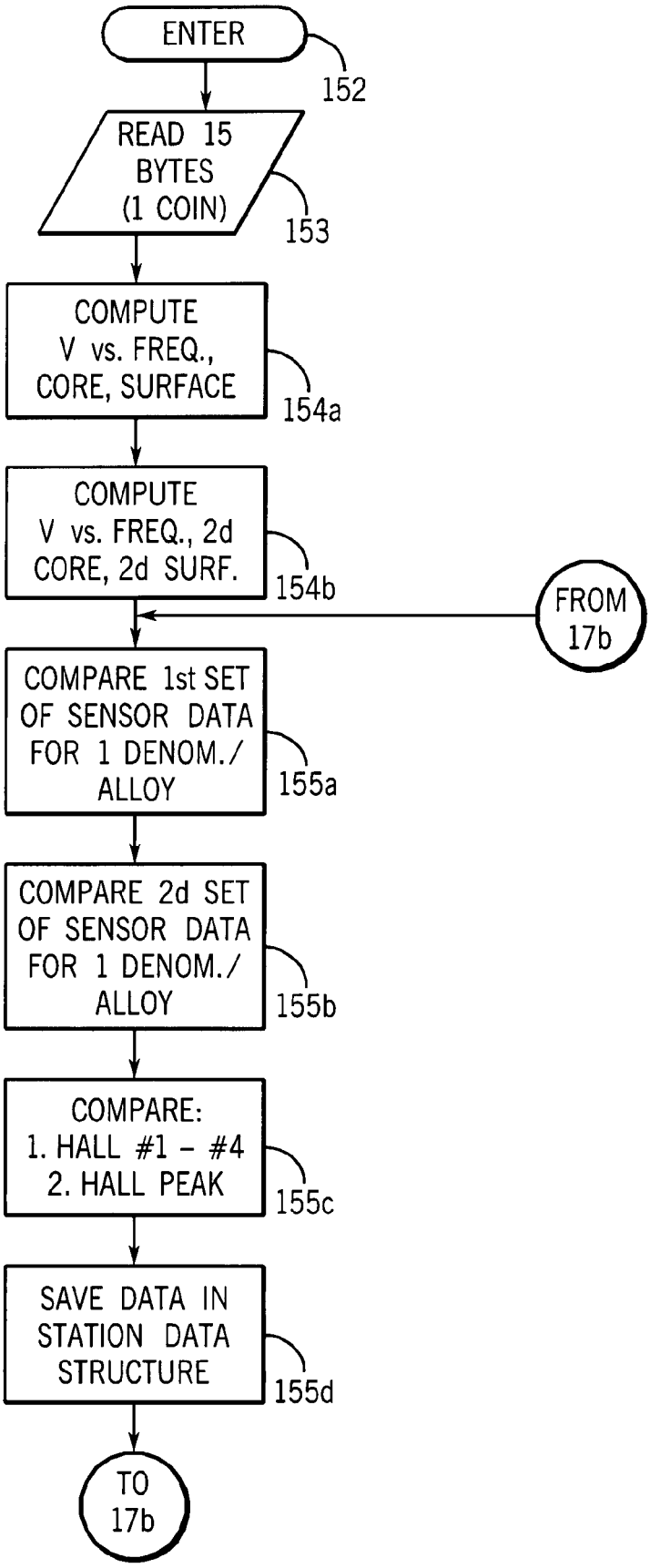
Figure 17B:
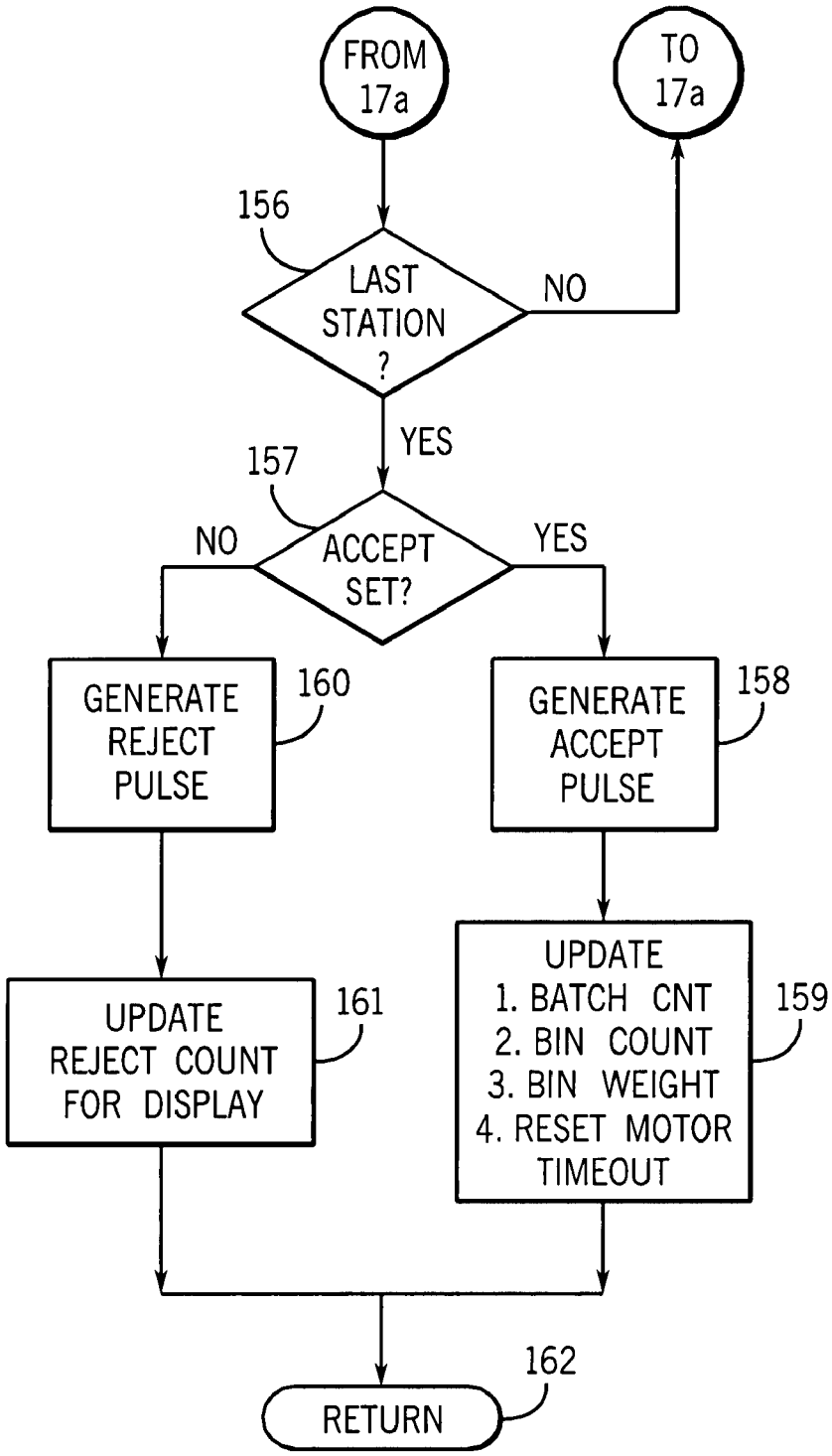

After the acceptance test limits are set for up to sixteen denomination/alloy specifications, instructions are executed as represented by decision block 137 to determine whether the calibration mode has been selected. If the answer is "YES", the calibration routine represented by process block 138 and FIG. 16 is executed. If the answer is "NO", the coin accept/reject routine represented by process block 139 and FIG. 17*a* and 17*b* is executed. After calibration routine 138 is executed, the machine controller 120 enters a wait mode, as represented by end block 141. When block 139 is executed, the machine controller 120 will continue to loop through that routine until a reset is received indicating a mode change input from a human operator.

Referring next to FIG. 16, assuming that the calibration mode has been selected in decision block 138, the machine controller 120 enters a calibration routine as represented by start block 142 in FIG. 16. A CPU in the machine controller then executes program instructions represented by decision block 143 to determine if calibration data should be cleared for any denomination/alloy specification. If the result of this decision is "YES" then machine controller 120 executes program instructions represented by process block 144 to zero out all data for coin size, thickness, core alloy composition, surface alloy composition and Hall effect sensor data. This will be done for any of the sixteen coin specifications which have not been selected. The processor will the exit the calibration routine. If the result of this decision is "NO" then the machine controller 120 executes program instructions represented by process block 145 to read data for 32 coins for each denomination and each selected denomination/alloy specification from the CPU 111 in the sensor module 67 (FIG. 14).

As represented by process block 146, the machine controller 120 then calculates the average value for thirty-two (32) coins for the single-dimension value of coin size, such as diameter. Next, it proceeds as represented by process block 147 to calculate a cluster of thirty-two values received from the "core alloy" sensor. Because this sensor generates data for both voltage magnitude and frequency, a "least squares" method is used to fit a curve to the two-dimensional plot of data points. The curve has a slope, A, an axis-intercept, B, and a Δ factor as described by equations 1), 2) and 3) mentioned above.

When thirty-two readings of voltage and frequency for a "surface alloy," for example, are plotted on an x-y graph, it produces a field of points. Using the above equations, a curve is determined for use as baseline for calculating a lower acceptance limit and an upper acceptance limit. To provide a better set of data for use with the least squares algorithm, a clustered values algorithm is also applied to the data. The resulting data for each denomination/alloy specification is stored in single data structure to provide faster execution during coin detection operations.

The above procedure for core alloy composition is also applied to data for surface alloy composition based on a calibration run of thirty-two coins, and this is represented by process block 147*a*.

In this case, there are a second set of core and surface readings that are processed, as represented by process blocks 148 and 148*a*.

Then, as represented by process block 149, an average value is calculated from thirty-two readings for edge thickness, and similarly an average value is calculated for thirty-two readings of four Hall sensor values and a peak Hall sensor value.

As represented by process block 150, a CPU in the machine controller 120 then executes program instructions to confirm that each item of coin data is within four (4) standard deviations of an average value before the calibration is confirmed. If the calibration is not confirmed, a "recalibration" message is generated. After the execution of block 150, the routine is exited to return to the main/startup loop of FIG. 15, as represented by return block 151.

Referring back to FIG. 15, if the coin accept/reject routine is to be executed as a result of executing decision block 137, the CPU in the machine controller 120 proceeds to the routine illustrated in FIGS. 17*a* and 17*b*. After entering this routine, as represented by start block 152, the machine controller 120 executes instructions represented by input block 153 to read fifteen data readings from the sensor module 67, as mapped in FIG. 12. As represented by process block 154*a*, the CPU in the machine controller 120 then executes instructions to use the voltage data for the core alloy composition to determine the proper frequency range for the respective coin denomination/alloy specification. This process is next performed for the surface alloy voltage and frequency. Next, as represented by process blocks 154*b*, the CPU in the machine controller 120 executes instructions to use the voltage data for a second set of readings for core alloy composition and surface alloy composition to determine the proper frequency ranges for the respective coin denomination/alloy specification. Next, as represented by process block 155*a*, a first set of data for coin size, thickness, core alloy frequency, surface alloy frequency and Hall sensor readings are compared to a range for a single corresponding respective coin denomination/alloy specification. Next, as represented by process block 155*b*, a second set of data for coin size, thickness, core alloy frequency, surface alloy frequency and Hall sensor readings are compared to a range for a single corresponding respective coin denomination/alloy specification. Next, four items of Hall sensor data and data for a peak Hall sensor reading are compared to the range for the respective station (specification). If the data are acceptable they are stored in the data structure for that station.

Next, as represented by decision block 156 in FIG. 17*b*, if the data is not within range of a first selected and active coin denomination/alloy specification, a comparison is made with the limits for the next and active denomination/alloy specification, until all active coin denomination/alloy specifications have been tested. Calculations that require long execution times have been previously performed in the execution of the routines illustrated in FIGS. 15 and 16. The routine illustrated in FIGS. 17*a* and 17*b* is written in assembly language and executes very quickly to allow for processing of from 3000 coins to 4500 coins per minute. After each active coin denomination/alloy specification is checked, decision block 156 is executed to see if this is the last active coin denomination/alloy specification, and if the result is "NO", the routine loops back to execute process block 155*a*. When the result is "YES," the routine proceeds to set a flag to accept or reject the coin as represented by decision block 157. Depending on an accept/reject determination in decision block 157, the processor proceeds to generate an accept pulse to coin ejector mechanism 32, as represented by process block 158, or a reject pulse, as represented by process block 160, to operate the coin ejector mechanism 74 (FIG. 3). If the coin is accepted, then process block 159 is executed to update the coin batch count and total value, update the bin count and total value, update the bin weight and to reset a motor timeout timer, as represented by process block 159. If the coin is rejected in block 160, a rejected coin count is updated for display to the machine user as represented by process block 161. After one of these actions, the routine returns to the main loop/startup routine of FIG. 15 as represented by return block 162.

From this it can be understood how data from the various sensors in the sensor module assembly 67 are used to identifying the coin denomination by coin size and to identify invalid coins for offsorting. The optical imaging and coin discrimination sensors are housed in a single coin sensor assembly 67 which can handle coins fed at rates from 3000 coins per minute up to 4500 per minute past the sensor module assembly 67.

This has been a description of preferred embodiments of the invention. Those of ordinary skill in the art will recognize that modifications might be made while still coming within the scope and spirit of the present invention as will become apparent from the appended claims.

We claim:

1. A coin sensor for detecting a size of an individual coin in a plurality of coins being moved within a coin handling machine, the coin sensor comprising:

a coin track over which coins pass in a single file;

an illumination source for illuminating at least portions of the coins as the coins move along the coin track;

an optical detector spaced from the coin track for detecting a size of at least a portion of each coin passing the coin sensor along the coin track; and a telecentric lens positioned between the optical detector and the coin track, such that the portion of each coin passing the optical detector is seen to have an apparent size and configuration independent of a variation in distance of the coin from the telecentric lens as each coin moves along the coin track;

a reflector positioned above an inside edge of the coin track; and wherein the illumination source is positioned below the inside edge of the coin track.

2. The coin sensor of claim 1, wherein the coins are provided with cantilevered portions over the inside edge of the coin track, and wherein the optical detector is positioned below the inside edge of the coin track.

3. The coin sorter of claim 2, wherein the optical detector is a linear pixel array of optical detector elements.

4. The coin sensor of claim 2, wherein the telecentric lens is disposed on an axis that is at an angle in a range from two degrees to thirty degrees from vertical, so as to block reflections from the cantilevered portions of the coins.

5. The coin sensor of claim 4, wherein the telecentric lens is more particularly disposed on an axis that is at an angle at about five degrees from vertical.

6. The coin sensor of claim 1, further comprising a first transparent cover disposed over an opening to the telecentric lens, and wherein a spacing between the first transparent lens cover and the coin track is in a range from 0.1 cm to 5 cm.

7. The coin sensor of claim 6, wherein a spacing between the coin track and the reflector is in a range from 2.5 cm to 7.5 cm.

8. The coin sensor of claim 7, wherein the reflector comprises a reflective sheet material and a second transparent cover disposed over the reflective sheet material.

9. The coin sensor of claim 1, wherein the illumination source provides parallel beams of light and wherein the detector operates as a line sensor.

10. The coin sensor of claim 1, further comprising a processor for receiving signals from the optical detector and for producing size data to be transmitted to a controller for accumulation and display.

11. The coin sensor of claim 1, wherein the coins are moved along the coin track at a rate up to 4500 coins per minute.

12. The coin sorter of claim 1, further comprising:

a coin core alloy composition sensor for detecting coin core alloy composition as the coin passes over the coin track;

a coin surface alloy composition sensor for detecting coin surface alloy composition as the coin passes over the coin track;

an edge sensor for sensing a parameter related to a thickness of the coin;

a Hall effect sensor for detecting a magnetic condition of a coin as the coin passes over the coin track; and further comprising an electronic control portion that receives data from the coin core alloy composition sensor and the coin surface alloy sensor for comparison with stored values for a plurality of coin specifications to determine if the coin should be accepted as meeting any one of the coin specifications or should be rejected.

13. The coin sensor of claim 12, wherein the electronic control portion receives data from the edge sensor for comparison with stored values for a plurality of coin specifications to determine if the coin should be accepted as meeting any one of the coin specifications or should be rejected.

14. The coin sensor of claim 12, in which the coin track, the optical detector, the coin core alloy composition sensor, the coin surface alloy composition sensor and the edge sensor, and the Hall effect sensor and the electronic control portion are all housed in a coin sensor housing assembly.

* * * * *